US006645092B1

(12) United States Patent
Hendren

(10) Patent No.: US 6,645,092 B1
(45) **Date of Patent: *Nov. 11, 2003**

(54) MULTI-PURPOSE GOLF TOOL

(76) Inventor: Ronald D. Hendren, 4196 White Oak La., Excelsior, MN (US) 55331

( * ) Notice: Subject to any disclaimer, the term of this patent is extended or adjusted under 35 U.S.C. 154(b) by 0 days.

This patent is subject to a terminal disclaimer.

(21) Appl. No.: 10/152,427

(22) Filed: May 21, 2002

Related U.S. Application Data

(63) Continuation-in-part of application No. 09/790,424, filed on Feb. 21, 2001, now Pat. No. 6,514,159.

(60) Provisional application No. 60/189,928, filed on Mar. 16, 2000.

(51) Int. Cl.[7] ..... A63B 57/00

(52) U.S. Cl. ..... 473/408; 473/285; 473/286

(58) Field of Search ..... 473/282, 285, 473/286, 406, 408

(56) References Cited

U.S. PATENT DOCUMENTS 4,974,842 A * 12/1990 Widman ..... 473/406
5,149,087 A 9/1992 Thompson, Jr.
5,152,524 A 10/1992 Brown
5,160,134 A * 11/1992 McDonald ..... 473/406
5,285,990 A * 2/1994 Engel ..... 473/282
5,388,824 A 2/1995 Reimers
5,401,019 A 3/1995 Wissman et al.
5,529,299 A 6/1996 Bellagamba
5,582,554 A * 12/1996 Stryczek ..... 473/407
5,636,754 A * 6/1997 Ennis ..... 473/282
5,706,831 A 1/1998 Whitbeck
5,813,414 A 9/1998 Zutler et al.
6,004,229 A 12/1999 Fazekas
6,022,280 A 2/2000 Arenburg et al.
6,033,322 A 3/2000 England
6,050,905 A 4/2000 Tate
6,514,159 B2 * 2/2003 Hendren ..... 473/408

* cited by examiner

*Primary Examiner*—Steven Wong
(74) *Attorney, Agent, or Firm*—Haugen Law Firm PLLP

(57) ABSTRACT

A multi-purpose golf tool including a body member having a top, a bottom, a first lateral side, a second lateral side, a front surface and a rear surface is provided. The body member is equipped with one or more pivotable support arms for selectively supporting a plurality of golf club grips off a golf playing surface. An enclosure is removably secured to the body member for selectively storing or displaying various items contained therewithin.

22 Claims, 6 Drawing Sheets

MULTI-PURPOSE GOLF TOOL

CROSS-REFERENCE TO RELATED APPLICATION

This is a continuation-in-part application of application Ser. No. 09/790,424 filed Feb. 21, 2001 now U.S. Pat. No. 6,514,159 which itself claims priority under 35 U.S.C. §119(e)(1), of U.S. provisional application serial No. 60/189,928, having a filing date of Mar. 16, 2000.

TECHNICAL FIELD

The present invention generally, and more particularly to a multi-purpose golf tool, more particularly to a golf accessory useful as a golf playing surface repair tool, ball marker carrier, and a golf club grip rest for a plurality of clubs.

BACKGROUND OF THE INVENTION

It has become popular for many golf tools to have the structure necessary for accomplishing a plurality of tasks. One of such tasks is to repair ball marks (e.g. indentations in the ground surface resulting from a driven ball impacting the fairway, green etc.), as has been the custom with a two pronged device.

Conventional divot tools are often configured to include a body portion from which a pair of elongated legs extend in a generally mutually parallel arrangement. A golfer utilizes such divot repair tool by inserting the legs into a golf surface, either a fairway or a green, in order to spruce up the ground surface following a shot (i.e. restore the ground surface to its pre-shot condition). Such tools consist basically of familiar, expected and obvious structural configurations, notwithstanding the myriad of designs encompassed by the crowded prior art which have been developed for the fulfillment of countless objectives and requirements.

Beyond ground surface repair, a variety of devices, many of which have a multi-function, Swiss Army Knife-like character, are known to accomplish anything from ball marking to bottle opening. By way of example, U.S. Pat. No. 6,050,905 discloses a divot tool formed from a pair of cooperating body components which effectively house a golf ball marking pen therein. U.S. Pat. No. 6,033,322 discloses a divot tool which is adapted to hold a convention ball marker (i.e. a marker having a "stem" in the parlance of the disclosure). U.S. Pat. No. 6,022,280 depicts and describes a multi-purpose golf tool which includes a divot fixer, cleat-tightener club or cigar/cigarette rest, ball marker, and hinged money clip. Lastly, U.S. Pat. No. 6,004,229 discloses a divot tool configured for equipment maintenance (e.g. cleats and club heads) and equipped with a knife and bottle opener.

While heretofore known devices work with varying levels of efficiency, they suffer from one or more drawbacks. Among these drawbacks is complexity of design which increases device cost. Some devices are funtionally difficult to manipulate. Further still, some devices are inefficient in the method of ball marker storage, limited in their ability to support golf club grips off the playing surface, inefficient in divot repair, or aesthetically undesirable. Thus, it is highly desirable to provide a multi-purpose golf tool, which in addition to having the ability to efficiently repair ground surface marks and temporarily mark ball position, is adapted to securely support a plurality of golf club grips off the ground surface, as may be the case when several clubs are brought to a ball location in anticipation of the pending, or subsequent shot(s).

SUMMARY OF THE INVENTION

As product evolution (i.e. improvements in form and function) is for all practical purposes never ending, and in consideration of the shortcomings of heretofore known golf tools, a multi-purpose golf tool capable of selectively holding a plurality of golf club grips off a golf playing surface is provided. The tool includes a body member having a top, a bottom, a first lateral side, a second lateral side, a front surface and a rear surface. The body member is equipped with means for selectively supporting a plurality of golf club grips off a golf playing surface. The tool further includes an enclosure means removably secured to the body member for selectively storing and displaying items contained within the enclosure means.

Preferably, an elongate base extends from the bottom of the body member for engaging the golf playing surface. In addition, pivotable arms, adapted to be reversibly extendible from the lateral sides of the body member in furtherance of receiving a golf club grip, are further provided.

The foregoing and other objects, features, and advantages of the invention will become apparent with reference to the figures and from the following Detailed Description of the Invention. The figures are not necessarily to dimensional or to geometric scale, nor do they necessarily represent structures in accurate or representative relative scale. Emphasis rather is placed upon illustrating principals of the invention in a clear manner.

DETAILED DESCRIPTION OF THE PREFERRED EMBODIMENTS

Figure 1:
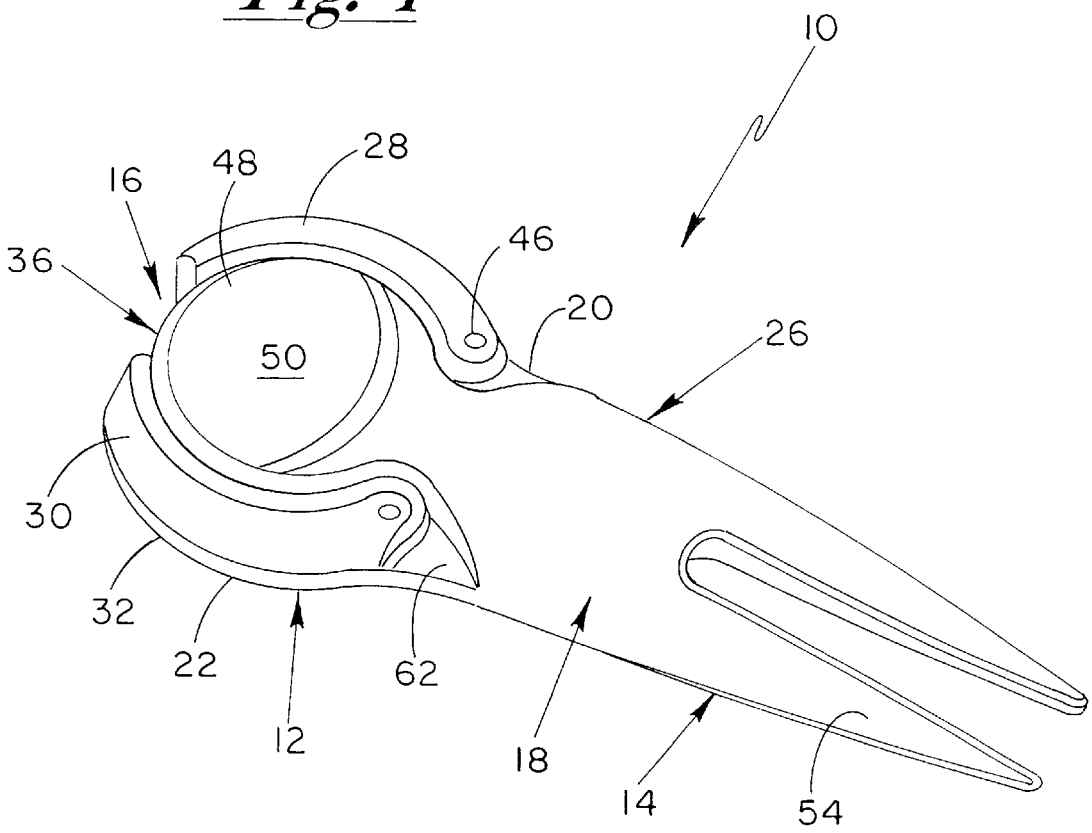
FIG. 1 is a perspective view of the device of the subject invention, particularly illustrating the lower or rear surface thereof.

With reference to the figures, it is generally seen that the golf tool 10 of the present invention is comprised of a body member 12 and an elongate base 14 extending from a portion thereof. More particularly the body member 12 has a top 16, a bottom 18, a first lateral side 20, a second lateral side 22, a front surface 24, and a rear surface 26, with the elongate base 14 extending from the bottom 18 of the body member 12 (i.e. in a direction away from the top 16 of the body member 12). It should be appreciated that terms, such as "front" and "rear" or "top" and "bottom" are used herein to establish a frame of reference for discussion and are in no way limiting.

Figure 2:
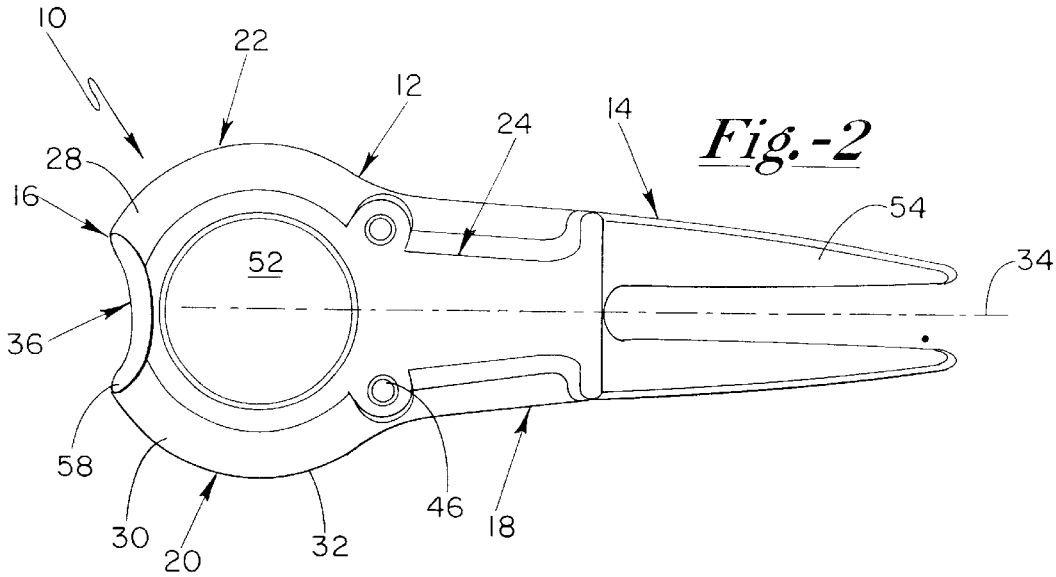
FIG. 2 is a front elevation view of the device of the subject invention, particularly illustrating the upper or front surface thereof.
Figure 2A:
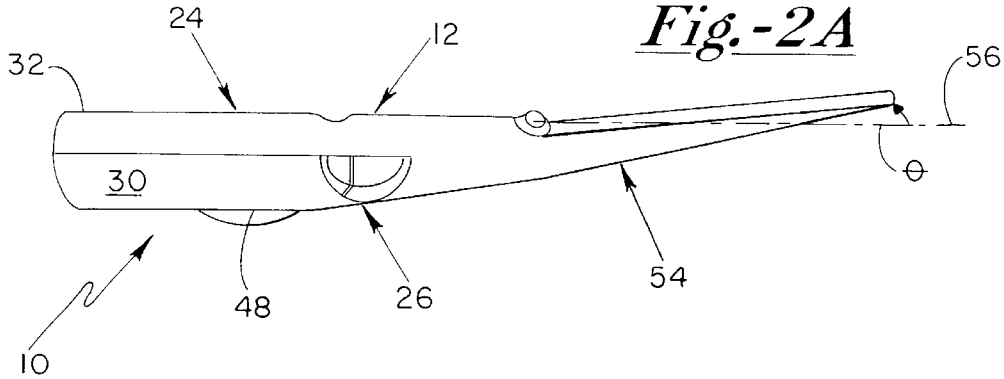
FIG. 2A is a side view of the device of FIG. 2.
Figure 2B:
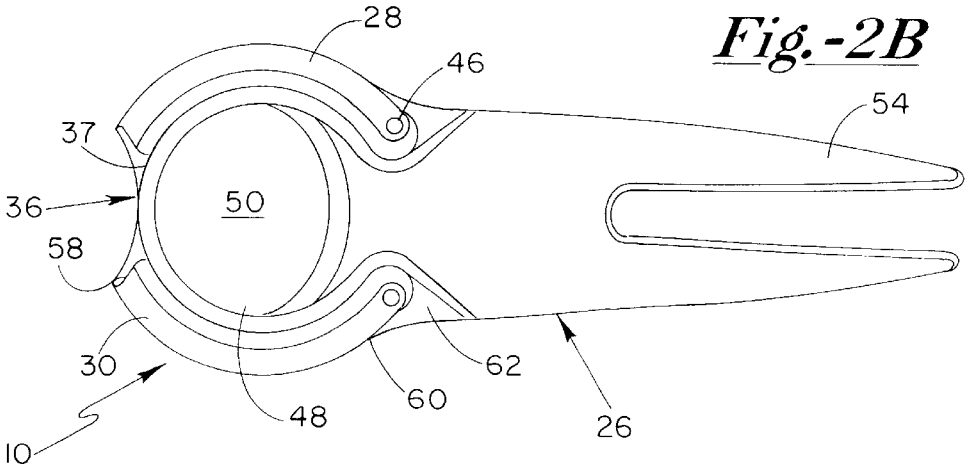
FIG. 2B is a rear elevation view of the device of FIG. 2, particularly illustrating the rear surface thereof.
Figure 3:
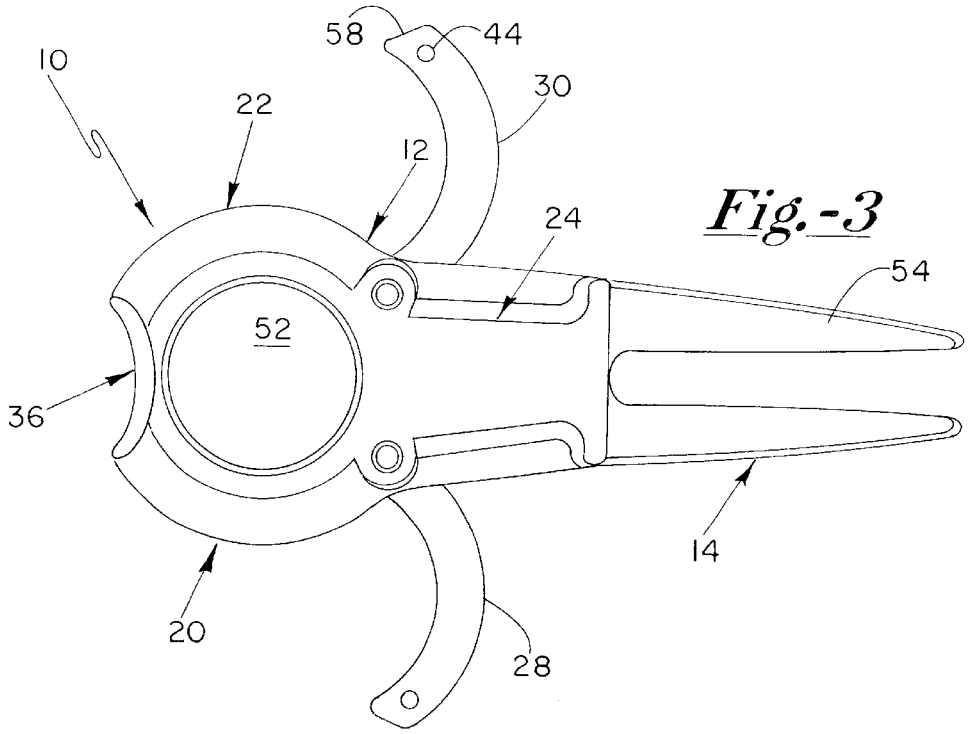
FIG. 3 is a front elevational view of the device of FIG. 2, particularly illustrating the arms thereof in a deployed condition.
Figure 3A:
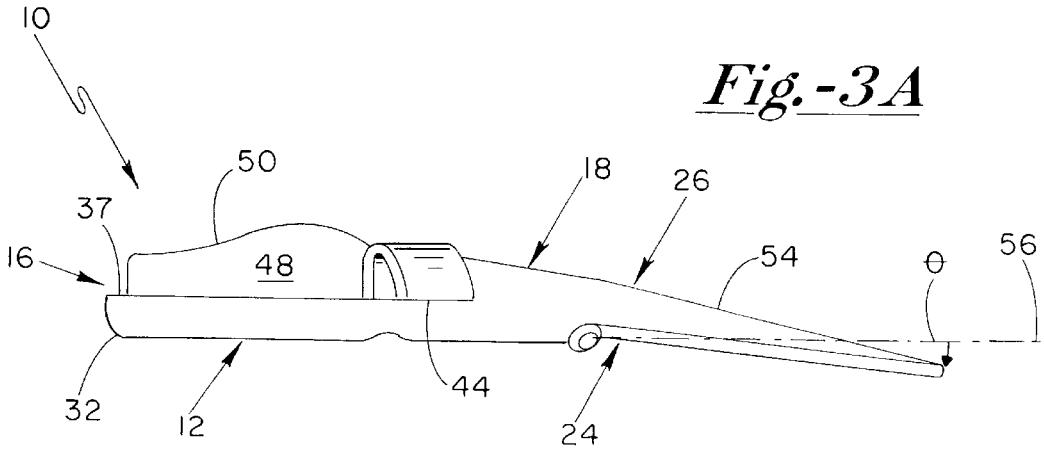
FIG. 3A is a side elevation view of the device of FIG. 3.
Figure 3B:
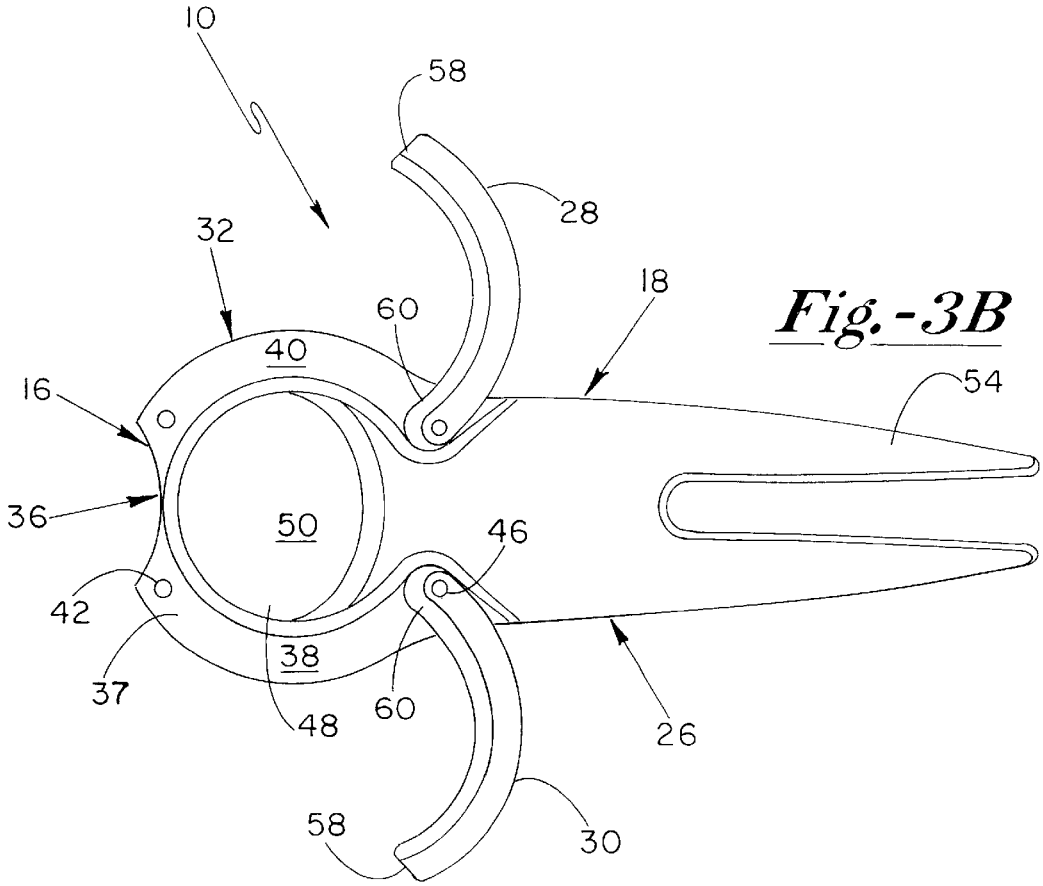
FIG. 3B is a rear elevation view of the device of FIG. 3, particularly illustrating the rear surface thereof.

As is best seen with reference to FIGS. 1, 2B, and 3B, the golf tool 10 of the subject invention further includes first 28 and second 30 pivotable arms adapted to be reversibly extendible from the first 20 and second 22 lateral sides of the body member 12 so as to receive a golf club grip in furtherance selectively support same over a golf playing surface. FIGS. 1, 2, 2A and 2B generally depict the tool of the subject invention with retracted arms (i.e. a closed configuration), whereas FIGS. 3, 3A, and 3B depict the tool with arms extended (i.e. an open configurations).

Referring now to FIGS. 3, 3A, and 3B, the body member 12 generally has an outer perimeter edge 32 which is preferably, but not necessarily, symmetrical about a longitudinal axis 34 of the tool 10. A portion 36 of the top 16 of the body member 12 (i.e. a portion of the top outer perimeter edge) is contoured to receivingly support a golf club grip off the golf playing surface. More particularly, the top 16 of the body member 12 is preferably concave across a lateral extent thereof. Such curvature permits sure placement and retention of a golf club grip so placed such that the grip may be elevated off the golf playing surface (i.e. when the base is received in the ground surface so that the tool performs its club rest function).

Figure 5:
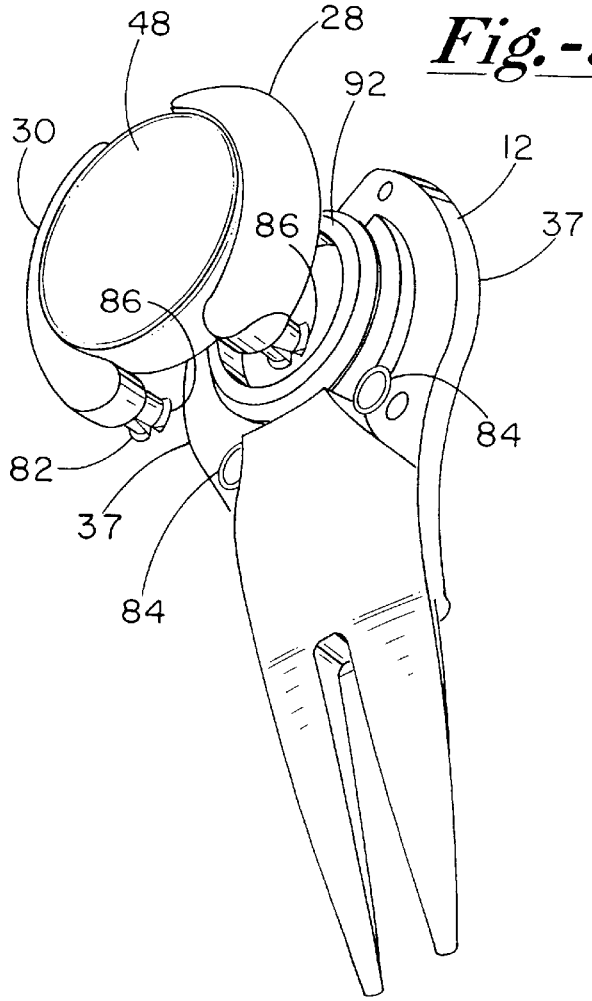
FIG. 5 is an exploded perspective view of the device of the present invention, particularly illustrating the pivotable arms and the removable enclosure means.

Adjacent the outer perimeter edge 32 of the body member 12 is a profiled surface 37 having first 38 and second 40 portions for receiving the first 28 and second 30 pivoting arms, as will be later discussed. Each portion 38, 40 of the profiled surface 37 includes a detent 42, shown proximal to the contoured top portion 36 of the body member 12, for receiving a knob or protuberance 44 carried by each of the pivotable arms 28, 30. Rivets, screws, pins, etc. 46 are positioned in the lower portion (i.e. to the right in FIGS. 3 and 3B) of the profiled surface 37, to extend through the thickness thereof, or extend from the surface of the body member, so as to operatively secure or fasten the pivotable arms 28, 30 to the body 12 in one of the many ways known to those of skill in the art. In a particular embodiment, as illustrated in FIG. 5, respective lower portions of pivotable arms 28, 30 preferably include locking tabs 82 extending therefrom. Such locking tabs 82 preferably lockingly engage with body member 12 by extending through corresponding apertures 84 disposed in profiled surface 37. Preferably, locking tabs 82 extend through apertures 84 in a relatively compressed configuration, and are allowed to expand once respective retention rings 86 emerge through aperture 84 at front surface 24, thereby pivotally retaining respective pivotable arms 28, 30 to body member 12.

Adjacent the profiled surface 37 is a thumb contact 48 (i.e. finger engaging structure) which, as best seen in FIGS. 3A and 3B, appears to depend or extend in a rearward direction from the profiled surface 37. This structure 48 generally has an increasing thickness (i.e. wedge like configuration) in a direction from body top 16 to body bottom 18 so as to permit a more particular transfer of hand motions, and thereby more efficiently direct same, to the elongate base 14 for divot repairs and the like, and preferably has a contoured surface 50 to facilitate finger (e.g. thumb) placement and grip.

In an alternative embodiment of the present invention, thumb contact 48 is removably attachable to rear surface 26 of body member 12. Preferably, thumb contact 48 is threadably engaged with boss 92 disposed on rear surface 26. In other embodiments, thumb contact 48 may be snappingly or otherwise removably engaged to rear surface 26 of body member 12.

Figure 6:
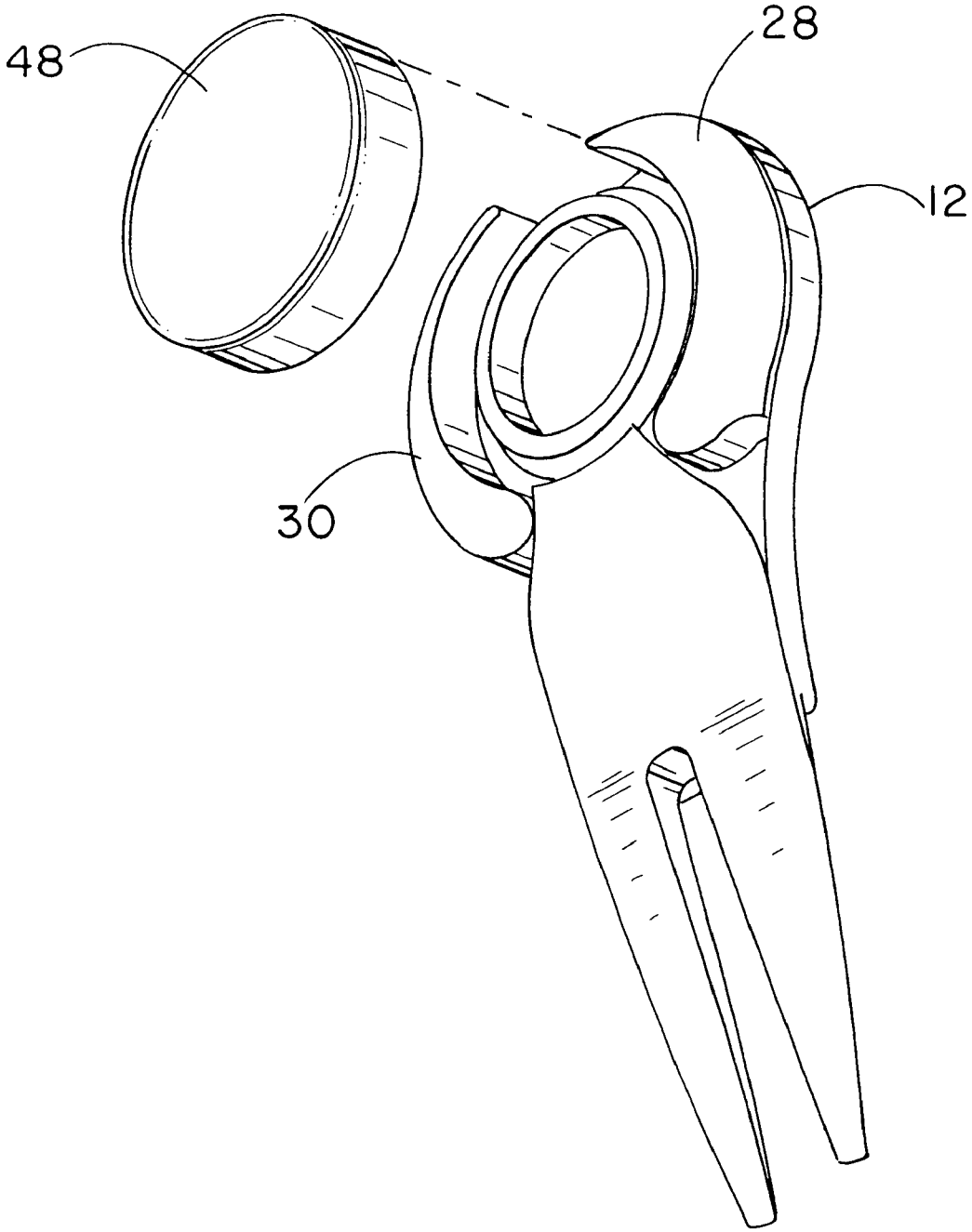
FIG. 6 is an exploded perspective view of the device of the present invention, particularly illustrating the removable enclosure means.

As best illustrated in FIGS. 5 and 6, thumb contact 48 may comprise a self-contained compartment defined by front surface 96, side surface 97, and rear surface 98. Such an enclosure may preferably store various items, including advertisements and messages. In preferred embodiments, front surface 96 of thumb contact 48, as illustrated in FIGS. 5 and 6, is fabricated from a substantially transparent material, such as a clear plastic. In such a manner, items stored within the compartment defined by thumb contact 48 may be viewed by users. It is contemplated by the present invention that such items within the enclosure may be used for advertising or other such purposes.

In other embodiments of the invention, thumb contact 48 may be fabricated from a substantially opaque material, whereby labels, indicia, or other information may be secured or integrated with front surface 96 of thumb contact 48. Such indicia, labels, or the like may also be utilized with thumb contact 48 being fabricated from a substantially transparent material.

Figure 4:
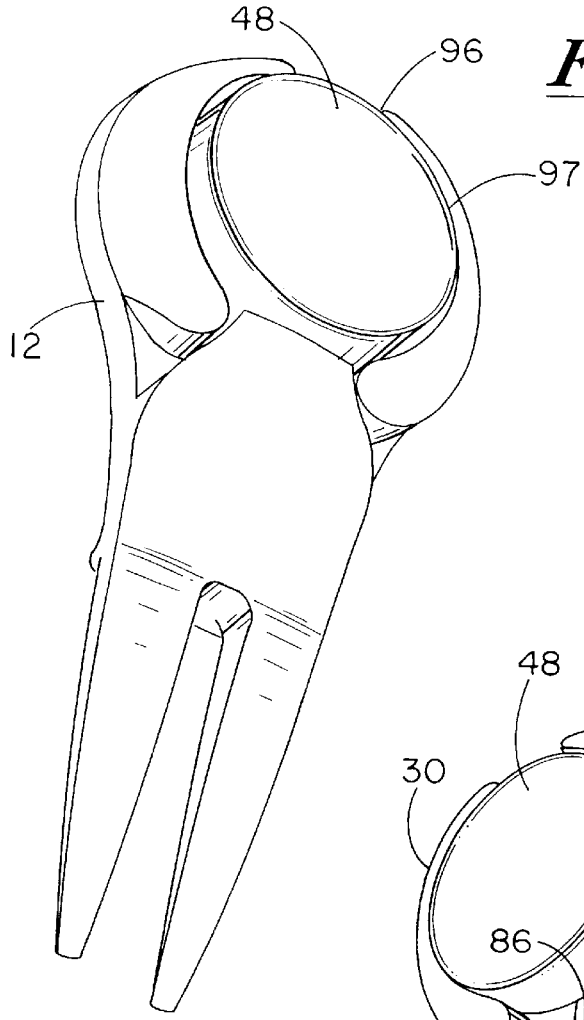
FIG. 4 is a perspective view of the device of the present invention, particularly illustrating the rear surface thereof, including removable enclosure means.

Thumb contact 48, as illustrated in FIGS. 4–6, preferably includes a means for accessing the enclosure defined by respective outer surfaces of thumb contact 48. In such a manner, items may be removably placed within such an enclosure for display or storage purposes. In other embodiments, however, the enclosure within thumb contact 48 may be permanently sealed, such that items within the enclosure defined by thumb contact 48 are permanently held therewithin.

Referring now to FIGS. 2 and 3, a ball marker 52 is carried by the body member 12, more particularly, the ball marker 52 is receivable in a recess (not shown) in the front or upper surface 24 of the body 12 (i.e. the body surface opposite the finger engaging structure). Preferably, the recess is equipped with a magnetic strip, or otherwise adapted as known to those of skill in the art, so as to secure a ball marker susceptible to magnetization within the recess. It is desirable, but not necessary that the magnetic strip have a surface area less than that of the ball marker so as to facilitate marker release from the recess as by applying pressure to the marker in an area having no underlying magnetic strip. It is to be understood that other ball marker retention schemes, magnetic or otherwise, are widely known, with the subject golf tool being readily adapted by those of skill in the art to include such alternate schemes without departing from the spirit of the subject invention.

The ball marker 52 preferably includes die struck indicia (not shown), such as a logo, etc. in furtherance of business promotion and the like. Painted enamel indicia is likewise contemplated for the exterior or outwardly facing surface of the ball marker (i.e. the visible marker surface of FIG. 2 or 3).

The elongated base 14 is preferably configured as shown in the figures so as to define a pair of legs 54, the nature of the base 14 being contingent upon the desired or sought after functionality (e.g. a pair of legs or prongs facilitate divot repair and likewise permit receipt of the tool in the ground in furtherance of elevating clubs off the ground surface). It should be appreciated that other base configuration are suitable without appreciably deviating from the scope of the subject invention. As is best seen with reference to FIGS. 2A and 3A, the legs 54 preferably extend angularly from a plane 56 substantially coextensive with the front surface 24 of the body 12, that is to say that the legs 54 angle or slant away from the finger engaging structure 48. An angle θ (FIGS. 2A and 3A) of between about 7 and 8 degrees, in combination with the configuration of finger engaging structure 48, and the overall tool geometry, yield a tool possessing superior ergonomics and divot repair capability.

Again referring to FIGS. 3 and 3B, pivotable arms 28, 30 are shown extended from the lateral sides 20, 22 of the body member 12. The arms 28, 30 are preferably curved so as to securingly cradle a golf club grip therein. Each of the arms has free 58 and fixed 60 ends. The distal surface of the free ends 58 of the arms 28, 30 are contoured to match a portion of the contour 36 of the top 16 of the body 12 (i.e. the arms, when retracted, do not intersect or otherwise interrupt the curvature of the top of the body, see FIG. 2B). Similarly, the arms 28, 30 have outer surfaces contoured to "fill" the profiled surface 37 of the body 12 (i.e. complete an exterior surface for the body, more particularly provide an aesthetic and functional transition between the outer perimeter edge 32 and the finger engaging structure 48, see FIGS. 1, 2A, and 3A). The arms 28, 30, in their closed configuration "hug" the finger engaging structure 48.

Knobs 44 are positioned proximal to the free ends 58 of the arms 28, 30 (FIGS. 3 and 3A) so as to be receivable in the detents 42 of the profiled surface 37 to secure the arms 28, 30 (i.e. latch the free ends 58 thereof) to or against the body 12 (i.e. prevent unintended deployment of the arms). As previously noted, the fixed ends 60 of the arms 28, 30 are operatively attached to the body member 12 for pivot motion using rivets, screws (with lock nuts and Teflon® washers), etc. 46. The range of pivot motion for each of the arms is defined by the extent of the profiled surface of the body member 12. More particularly, the profiled surface 37 has a longitudinal extent greater than that of the arms so as to define gaps 62 (FIGS. 1 and 2B) that the arms, when extended, "fill" (FIG. 3B). The extending arms 28, 30 eventually fill the gaps 62 so as to abut a portion of the bottom portion 18 of the body member 12, thereby preventing continued lateral extension of the arms 28, 30 in relation to the body member 12.

The tool of the subject invention is preferably cast using a strong metal alloy having a brushed nickel finish. An important consideration for the tool is durability: it must be strong enough to withstand heavy use in repairing divots, with the arms being resistant to bending or deformation, and likewise capable of withstanding years of opening and closing without failure of the pivot linkage.

Since many possible embodiments may be made of the present invention without departing from the scope thereof, it is to be understood that all matter herein set forth or shown in the accompanying drawings is to be interpreted in an illustrative and not limiting sense.

What is claimed is:

1. A golf tool comprising:

(a) a body member having a top, a bottom, a first lateral side, a second lateral side, a front surface, and a rear surface, said body member including pivotable support means for selectively supporting a plurality of golf club grips off a golf playing surface said pivotable support means having a pivoting proximal end and a distal end, said pivotable support means being reversibly extendable from a first closed position wherein said distal end is adjacent said body member to a second open position wherein said distal end is spaced from said body member; and (b) enclosure means removably secured to said body member for selectively storing and displaying items contained therewithin, said enclosure means comprising a distinct body defining a compartment for selectively operably positioning items therewithin.

2. The golf tool of claim 1 wherein a portion of said top of said body member is contoured to receivingly support a golf club grip off the golf playing surface.

3. The golf tool of claim 2 wherein said portion of said top of said body member is concave across a lateral extent of said body member so as to cradle a golf club grip.

4. The golf tool of claim 1 wherein said pivotable support means include first and second pivoting arms adapted to be reversibly extendible from said first and second lateral sides of said body member.

5. The golf tool of claim 4 wherein said pivoting arms are curved to securingly cradle golf club grips.

6. The golf tool of claim 5 wherein each of said pivoting arms include opposing proximal and distal ends.

7. The golf tool of claim 6 wherein respective said distal ends have a distal surface contoured to match a portion of said contour of said top of said body member.

8. The golf tool of claim 6 wherein respective said proximal ends are pivotably secured to said body member by locking tabs.

9. The golf tool of claim 1 wherein said enclosure means is substantially transparent.

10. The golf tool of claim 1 wherein said enclosure means is threadably engaged on said rear surface of said body member.

11. The golf tool of claim 1, including one or more items disposed within said enclosure means.

12. The golf tool of claim 6 wherein said distal ends cooperatively engage a portion of said body member for latching said distal ends of said pivoting arms in a closed position against said body member.

13. The golf tool of claim 12 wherein said pivoting arms are received within a profiled surface of said rear surface of said body member.

14. The golf tool of claim 4 further comprising a ball marker for marking a ball location, said ball marker being removably secured to said body member.

15. The golf tool of claim 14 where said ball marker is operably received in a recess in said upper surface of said body member.

16. The golf tool of claim 15 wherein said ball marker is operably magnetically held within said recess for selective removal therefrom.

17. The golf tool of claim 16 wherein at least a portion of said recess is magnetized.

18. The golf tool of claim 16 wherein at least a portion of said marker is magnetized.

19. The golf tool of claim 15 wherein said ball marker includes indicia.

20. The golf tool of claim 1, including an elongate base extending from said body member.

21. The golf tool of claim 20 wherein said elongate base includes a pair of legs angularly extending from a plane substantially coextensive with said front surface of said body member.

22. The golf tool of claim 21 wherein the extent of angulation of said pair of legs is within the range of about 7 to 8 degrees.

* * * * *